United States Patent [19]

Goerlich

[11] Patent Number: 4,852,797

[45] Date of Patent: Aug. 1, 1989

[54] PROCESS FOR OPERATING A FUEL-OPERATED HEATER AND CONTROL ARRANGEMENT FOR PERFORMING THE PROCESS

[75] Inventor: Dieter Goerlich, Emmering, Fed. Rep. of Germany

[73] Assignee: Webasto AG Fahrzeugtechnik, Gauting, Fed. Rep. of Germany

[21] Appl. No.: 116,342

[22] Filed: Nov. 4, 1987

[30] Foreign Application Priority Data

Nov. 15, 1986 [DE] Fed. Rep. of Germany ..... 3639172

[51] Int. Cl.[4] ..... G05D 23/00

[52] U.S. Cl. ..... 237/2 A; 237/12.3 C

[58] Field of Search ..... 236/11; 237/50, 53, 237/55, 2 A, 12.3 C, 12.3 A; 126/110 D, 110 B

[56] References Cited

U.S. PATENT DOCUMENTS

| | | | |
|---|---|---|---|
| 2,266,563 | 12/1941 | McCorkle | 236/11 X |
| 4,530,658 | 7/1985 | Panick | 431/329 |
| 4,537,345 | 8/1985 | Brown | 237/53 X |
| 4,685,616 | 8/1987 | Stein | 237/12 |

FOREIGN PATENT DOCUMENTS

| | | | |
|---|---|---|---|
| 3509349 | 9/1986 | Fed. Rep. of Germany | 237/12.3 C |

*Primary Examiner*—Henry A. Bennet

*Attorney, Agent, or Firm*—Sixbey, Friedman, Leedom & Ferguson

[57] ABSTRACT

A process for operating a fuel-operated heater, in which the instantaneous operating condition of the heater is determined according to appropriate criteria and the maximum producible heating power is adjusted according to it. The instantaneous operating condition of the heater is used as the control value for instantaneous maximum producible heating power to optimize the yield of the heating power of the heater without exceeding safety limits, especially component safety limits. Further, an arrangement for performance the process has a detection device, such as a sensor for determination of a characteristic component temperature, which works together with an adjustment device for adjusting the instantaneous maximum producible heating power. This adjustment device controls the fuel feed device of the heater by an actuator and appropriately changes the amount of fuel fed to the burner of the heater. Additionally, the amount of combustion air fed to the burner can, optionally, be appropriately changed.

21 Claims, 2 Drawing Sheets

PROCESS FOR OPERATING A FUEL-OPERATED HEATER AND CONTROL ARRANGEMENT FOR PERFORMING THE PROCESS

BACKGROUND AND SUMMARY OF THE INVENTION

This invention relates to a process for controlling operation of a fuel-operated heater, especially of a vehicle auxiliary heater and to a control arrangement for this purpose.

In heaters, which have air as a heat transfer medium, such as that of U.S. Pat. Nos. 4,530,658 and 4,685,616 as well as German Offenlegungsschrift No. 35 09 349, the temperature in the heat exchanger determines the value of the heating power that can be reached with the heater without damaging the components. In this case, the temperature in the heat exchanger is dependent on the temperature and amount of air drawn in, or water circulated, to be heated by the heat exchanger for production of the heating air. Since in the operation of such heaters, different air or water throughputs and temperatures as well as different fuel amounts can occur, so that for reasons of safety of the components, in the usual control and adjustment of the heater the nominal (rated) heating power of such a heater must be lowered in comparison with that heating power that could be delivered at maximum permissible heat exchanger temperature.

Control processes and devices for heating devices are known. U.S. Pat. No. 4,685,616 discloses one such process and a switching means for a heating device wherein a temperature gradient with respect to time is utilized as a governing value in controlling operating conditions of the heating device with a goal of achieving increased efficiency by coordinating heat supply to heat demand while also avoiding critical operating conditions. Furthermore, in allowed U.S. patent application Ser. No. 863,459, filed May 15, 1986, a heating device is disclosed having a control unit for controlling operation of the heating device which utilizes a pair of temperature sensors to constantly monitor operating conditions of the heat exchanger of the heating device (based upon a temperature differential occurring between the sensors) so as to detect operating conditions which could potentially cause an overheating condition to occur. In response to such a potential overheating causing condition being detected, operating conditions of the heating device are modified to prevent the device from actually overheating. However, such control systems are not designed to increase output performance (i.e., to increase performance above the theoretical, rated output, value) of a heating device.

The invention, therefore, aims at providing a process for operating a heater of the initially mentioned type, as well as a control arrangement for this purpose, which allows a more complete use of the deliverable heating power. That is, to provide a process for an arrangement which does more than merely reduce output when actual conditions prove excessive relative to designed for conditions, and will also increase output when actual conditions are less demanding than maximum designed for conditions.

For this purpose, a process for operating a fuel-operated heater of such a type is distinguished by the fact that the maximum instantaneously producible heating power is adjusted in accordance with the instantaneous operating condition of the heater. Therefore, in this operating process, an instantaneous operating condition of the heater, e.g., the load condition or the temperature at the most highly loaded spots of the heater, is taken as the control variable for the instantaneously maximum producible heating power. Thus, the process according to the invention makes it possible to always operate such a heater within the limiting power range without the components, for example, being endangered by overload. In this way, the heating power producible with the heater can be optimized and increased without the basic principles of such a heater having to be changed.

According to a preferred embodiment of the process according to the invention a characteristic component temperature is used as a control variable for determination of the instantaneous operating condition of the heater, and in this case, the temperature of the heat exchanger is suitable. Since, generally, the end of the heat exchanger, on which the hot combustion gases coming from the combustion chamber are deflected in an opposite direction, is most critical, the temperature at that end of the heat exchanger is considered as th e controlling value for the instantaneous operating condition in the heater.

Alternatively, the instantaneous operating condition of the heater can also be determined from the temperature of the heating air, since this temperature is in a relatively constant ratio to that of the temperature-critical areas of the heater.

According to the invention, the adjustment of the heating power takes place with the help of an adjustment of the amount of fuel that is fed to the burner. In this connection, it can be suitable to, additionally, adjust the amount of combustion air fed to the burner.

According to a second essential aspect according to the invention, a control arrangement for carrying out of the process is provided which has a detection device for detecting the instantaneous operating condition of the heater as well as an adjustment device for the instantaneous maximum producible heating power, which works with the detection device.

If, with such a control arrangement, a characteristic component temperature is detected as the controlling value for the instantaneous operating condition, a temperature sensor is preferably placed on the heat exchanger, namely on its end. Alternatively, the detection device can detect the temperature of the heating air, for example, with the help of a temperature sensor in the outgoing heating air current, to affect, in an appropriate way, the adjustment device for the instantaneous maximum producible heating power.

For the adjustment of the maximum producible heating power, preferably, an amount adjustment device is present which appropriately controls the amount of fuel fed to the burner in accordance with the detected operating condition. In addition, the amount of combustion air is also optionally adjusted.

Further, for the maximum producible heating power, the adjustment device can also be connected to a sensor for the heating air discharge temperature and/or for the ambient temperature so that these influencing values can be considered as reference values in the adjustment device to match the heating power that can be delivered by the heater to the actual heating requirements.

In summary, the process principle and arrangement according to the invention make it possible, in the case of heaters of a predetermined size, for the maximum producible heating power to be increased without danger to the components. Also the heating air temperature changes essentially less as a function of the temperature of the air drawn in. Further, this increased heating power is achieved in such a way that only insignificantly more electric power must be used for the operation. Simultaneously, the heating up time is shortened, since the heater ca n be operated with maximum and, according to the invention, with increased maximum heating power.

These and further objects, features and advantages of the present invention will become more obvious from the following description when taken in connection with the accompanying drawings which show, for purposes of illustration only, a single embodiment in accordance with the present invention.

DETAIL DESCRIPTION OF THE PREFERRED EMBODIMENT

Figure 1:
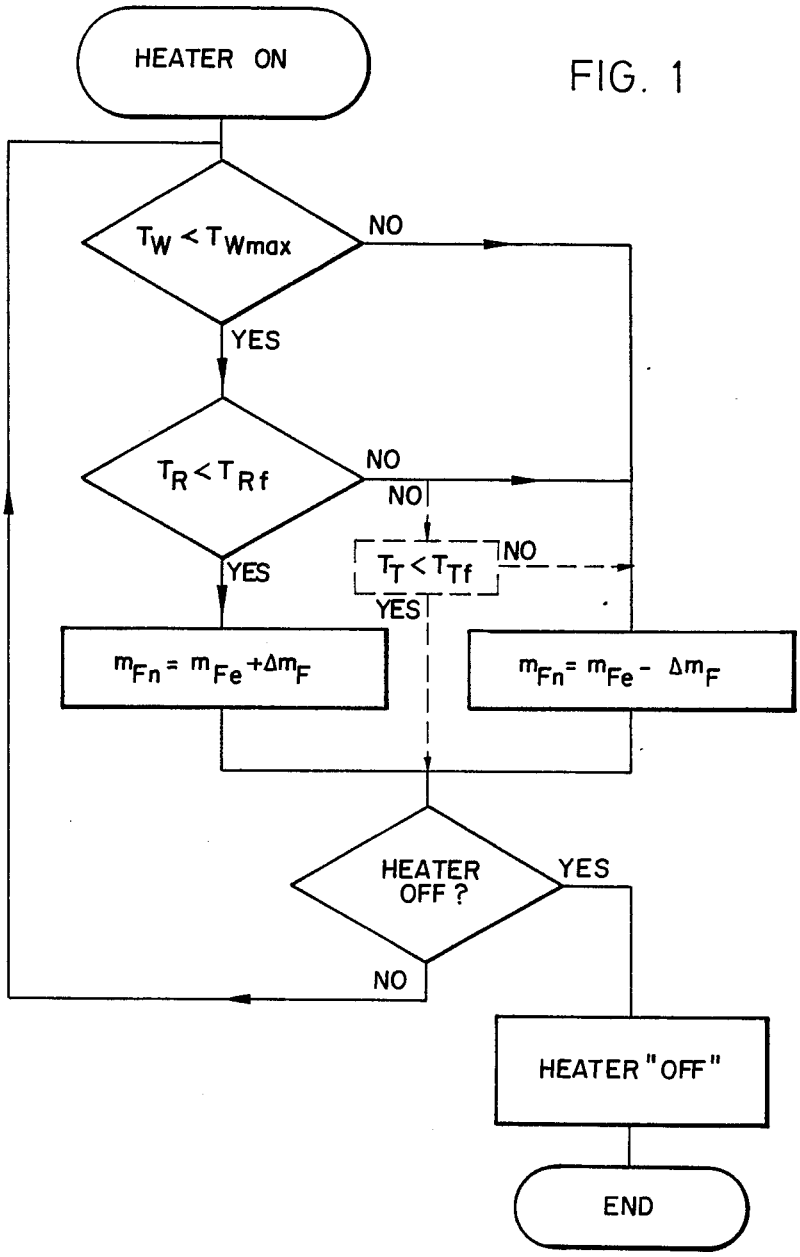
FIG. 1 is a flow diagram showing a preferred operating process in accordance with the invention.

The sequence of the operating process according to the invention is diagrammatically represented in the flow diagram according to FIG. 1. As an example, in this case, the instantaneous operating condition of the heater is determined by considering a characteristic component temperature, namely temperature $T_W$ of the heat exchanger of the heater. After the heater is turned on, it is determined whether this temperature $T_W$ of the heat exchanger is less than a temperature limit, $T_{Wmax}$, i.e., the maximum permissible temperature of the heat exchanger (which may be a fixed value that is set depending on the characteristics of the particular heater to be controlled and the particular circumstances of use, e.g., it would be lower if the heater were installed next to a high temperature source such as an internal combustion of a motor vehicle).

In addition to this basic control, second layer of control may be superimposed. Thus, as represented, if the answer is affirmative, it is determined whether the room temperature $T_R$ (which may be an actually sensed room temperature or a projected one) is less than a fixed value $T_{Rf}$ (which can be a desired value set by the user; or if no value is chosen by the user, a predetermined, fixed value). If this is the case, the amount of fuel, $m_F$, is increased from a basic fuel amount, $m_{Fb}$, by an amount $\Delta m_F$. Then if the heater is operated under these conditions, the adjustment cycle begins all over again, by the temperature of the heat exchanger $T_W$ being compared with the limiting temperature $T_{Wmax}$, the room temperature being compared with the fixed temperature and, if appropriate, the existing fuel amount $m_{Fe}$ (which originally equaled the basic amount $m_{Fb}$) increased by $\Delta m_F$ to produce a new fuel amount, $m_{Fn}$.

If the temperature $T_W$ of the heat exchanger is greater than the limiting temperature $T_{Wmax}$, or if the room temperature $T_R$ is greater than the fixed value, $T_{Rf}$, the amount of fuel $m_F$ is reduced by an amount $\Delta m_F$.

With the heater being operated in this condition, the adjustment cycle is rerun starting from the comparison with the limiting temperature $T_{Wmax}$, to adjust the maximum producible heating power, depending on need, in each case in accordance with the instantaneous operating condition of the heater. When a signal indicating that the heater is "off" occurs, cutoff takes place and the operation is ended. Instead of temperature $T_W$ of the heat exchanger, the instantaneous operating condition of the heater can also be determined from the temperature $T_{HL}$ of the heating air leaving the heat exchanger without changing the course the process from that represented in FIG. 1.

In addition to desired room temperature $T_R$ in the process according to the invention, the actual room temperature $T_T$ detected by a room thermostat can be considered in the adjustment (as represented in outline form) by comparing the ambient temperature (as opposed to the room temperature) with a fixed value $T_{Tf}$. The fixed value $T_{Tf}$ can, for example, be a value that is lower than $T_{Rf}$ (such as −10 degrees C.) so that under such low temperature conditions the fuel amount will not be decreased once the room temperature $T_R$ has reached the value $T_{Rf}$.

Further, in keeping with the change of the amount of fuel $m_F$ fed to the burner, in addition, the amount of fed combustion air can be changed. In this case (which is not shown in FIG. 1 for reasons of clarity, but is represented in FIG. 2 and described relative thereto), in conjunction with the change of the amount of fed fuel $m_F$, also, the amount of combustion air fed to the burner is then changed in an appropriate way, i.e., by becoming either greater or smaller.

Figure 2:
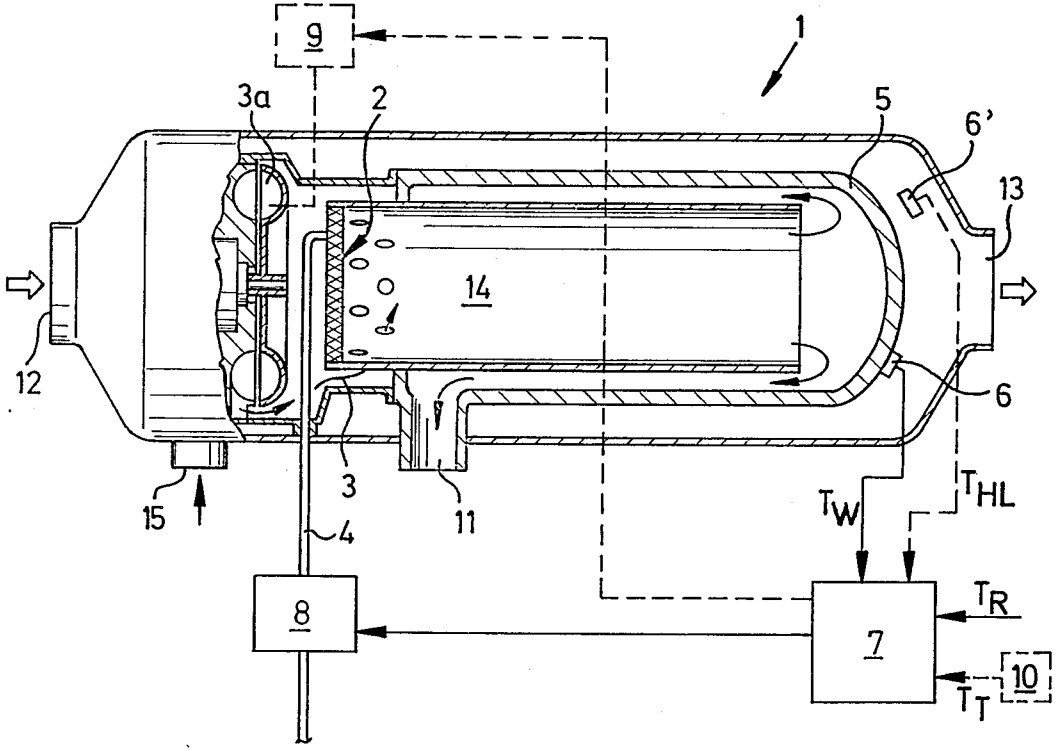
FIG. 2 is a block diagram of an arrangement, for performing the embodiment of the operating process of FIG. 1, with a diagrammatically represented heater, adjustment and detection devices as well as sensors and their arrangement possibilities.

A heater is represented in FIG. 2 with a block diagram for explaining the adjustment arrangement according to the invention. The fuel-operated air heater is indicated overall by 1 and has a burner 2, to which combustion air 3 is fed by a combustion air blower 3*a* and fuel is fed by a fuel feed device 4. The combustible mixture thus produced at burner 2 is burned in a combustion chamber 14 of heater 1. The hot combustion gases enter a heat exchanger 5. In heat exchanger 5 the combustion gases are in heat exchange relationship with heating air used as a heating medium, the heating air being drawn in to the heater at a heating air intake 12 and leaving heater 1 via a heating air outlet 13 after passing over heat exchanger 5, as represented by arrows in FIG. 2. Combustion air blower 3*a* sucks in air from the environment by an intake 15. After passage through heat exchanger 5, the exhaust gases leave heater 1 by an exhaust gas outlet 11. The heater 1, as described above, is of a conventional type of construction.

An arrangement for operating heater 1 according to the invention comprises a means for detection of the instantaneous operating condition of heater 1 in the form of a temperature sensor 6, which detects temperature $T_W$ of heat exchanger 5 as a characteristic component temperature. Preferably, this sensor 6 is placed on and fastened to the end of heat exchanger 5.

As is shown in broken lines in FIG. 2, instead of temperature sensor 6, which is provided on heat exchanger 5, it is possible to place a sensor 6' in the heating air current. In particular, sensor 6' is preferably placed in an outflow area of the heating air current from heater 1, i.e., near heating air outlet 13.

Temperature sensor 6 or 6' for the heating air temperature is connected to an adjustment control device 7, by means of which the maximum producible heating power can be adjusted based upon the characteristic value for the instantaneous operating condition of the heater. This adjustment control device 7, which serves as an actuator for achieving the maximum producible heating power of heater 1, is connected to an amount adjustment device 8, such as an electronically regulatable valve, for controlling the amount of fuel mF fed to burner 2. Adjustment control device 7 will either specify a fixed room temperature value $T_{Rf}$, which is compared in adjustment control device 7 with the desired value, $T_R$, or the value $T_R$ may be compared with a value $T_{Rf}$ that is set by the user in the manner of a room thermostat. Similarly, the value $T_{Wmax}$ is set in control device 7 as a theoretically established value determined on the basis of the physical and performance characteristics of the particular heater to be controlled as well as the particular circumstances of installation. The output of a sensor 10 which measures the ambient temperature $T_T$ may also be applied as an input to adjustment control device 7, as represented by broken lines in FIG. 2 and mentioned above. In accordance with the result of comparisons made, the fuel amount adjustment device 8 is acted on accordingly.

As further shown in broken lines in FIG. 2, in addition, an amount adjustment device 9 for combustion air can be acted on by another output of adjustment control device 7 to feed to the burner a changed amount of combustion air in accordance with the changed amount of fuel, $m_{Fn}$, fed to the burner by means of amount adjustment device 8. As a result, the combustion process in heater 1 can take place with the desired mixture ratio of fuel and combustion air.

The arrangement provided according to the invention with its individual components can, of course, be integrated into a control unit for a heater or may be provided as a separate additional arrangement, in the form of a printed circuit board or the like. Alternatively, the arrangement can be achieved by the use of a microprocessor for control of heater 1, in the form of a changed program flow of the microprocessor.

Of course, a characteristic component temperature, other than the heat exchanger temperature $T_W$ or heating air temperature $T_{HL}$ detected in the preferred examples, can be detected and utilized as a control value. Also, the invention may be applied to control the operation of heaters which use a liquid heat exchange medium instead of air. What is essential in the process according to the invention and to the control arrangement for performing the process is that the heater is operated in the maximum heating power range to achieve an optimal heating power with the smallest possible construction volume; i.e., the output is not limited by a theoretically determined rated power, but rather only maximum sustainable temperature of critical components as compared with an instantaneously measured operating condition thereof. Thus, as contrasted with typical heaters, instead of having a set, normal, full load operating condition that may be reduced to one or more partial load operating conditions, the present invention progressively increases or decreases burner operation to maximize safe output consistent with actual operation conditions.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Process for operating a fuel-burning heater, especially a vehicle auxiliary heater, without limiting the maximum heating power output to a predetermined fixed rated power output, in which fuel and combustion air are fed to a burner of the heater, and combusted for heating a heat exchange medium via a heat exchanger, wherein an instantaneous operating condition of the heater is determined and wherein the maximum heating power output producible by the heater is adjusted during operation of the burner in accordance with said instantaneous operating condition of the heater in a manner progressively increasing and decreasing output of the burner, as appropriate, to achieve the maximum heating power output of the heater safely obtainable under existing operating conditions as a function of the maximum sustainable temperature of critical components of the heater relative to the instantaneous operating condition determined without being limited to a predetermined fixed rated power output.

2. Process according to claim 1, wherein the instantaneous operating condition of the heater is determined from a characteristic component temperature.

3. Process according to claim 2, wherein the characteristic component temperature is the temperature of the heat exchanger.

4. Process according to claim 3, wherein the temperature of the heat exchanger is measured at an end of the heat exchanger.

5. Process according to claim 1, wherein the heat exchange medium is air and the instantaneous operating condition of the heater is determined from the temperature of the air that has been heated by the heat exchanger.

6. Process according to claim 5, wherein the amount of fuel fed to the burner is adjusted to adjust the heating power output.

7. Process according to claim 6, wherein, in addition, the amount of combustion air fed to the burner is adjusted to adjust the heating power output.

8. Process according to claim 3, wherein the amount of fuel fed to the burner is adjusted to adjust the heating power output.

9. Process according to claim 8, wherein, in addition, the amount of combustion air fed to the burner is adjusted to adjust the heating power output.

10. Process according to claim 1, wherein the amount of fuel fed to the burner is adjusted to adjust the heating power output.

11. Process according to claim 10, wherein, in addition, the amount of combustion air fed to the burner is adjusted to adjust the heating power output.

12. Process according to claim 2, wherein a ambient temperature value is considered along with the characteristic component temperature in determining the instantaneous operating condition.

13. Arrangement for controlling the output of a fuel burning heater without limiting the actual maximum heating power output to a predetermined fixed rated power output, comprising a detection device forming a means for determining an instantaneous operating condition of a heater, an output of the detection device being connected with an adjustment control device that operates as a means for adjusting the actual maximum producible heating power output of the heater by controlling operation of a burner thereof in accordance with the instantaneous operating condition in a manner progressively increasing and decreasing output of the burner, as appropriate, for achieving the maximum actual heating power output of the heater safely obtainable under existing operating conditions, whereby the heating power output is optimized as a function of the maximum sustainable temperature of critical components relative to the instantaneous operating condition determined by said means for determining without being limited to a predetermined fixed rated power output.

14. Arrangement according to claim 13, wherein the detection device determines a characteristic component temperature.

15. Arrangement according to claim 14, wherein the detection device comprises a temperature sensor, placed on a heat exchanger of the heater, for determination of the characteristic component temperature.

16. Arrangement according to claim 15, wherein the temperature sensor is placed on an end of the heat exchanger.

17. Arrangement according to claim 13, wherein the detection device comprises a means for determining the temperature of heating air serving as a heat exchange medium in the heater.

18. Arrangement according to claim 17, wherein said detection device comprises a temperature sensor, placed in an outflow of said heating air, for determination of the temperature of the heating air.

19. Arrangement according to claim 13, wherein said adjustment device is connected to an amount adjustment device regulating the amount of fuel fed to a burner of the heater as said means for the maximum producible heating power.

20. Arrangement according to claim 19, wherein an amount a combustion air adjustment device is provided for regulating the combustion air fed to the burner in conjunction with regulation of the fuel fed to the burner.

21. Arrangement according to claim 14, wherein the adjustment control device is connected to an ambient temperature sensor, the adjustment control device adjusting the maximum producible heating power as a function of said characteristic component temperature and the ambient temperature sensed by said ambient temperature sensor.

* * * * *